US006877630B2

(12) United States Patent
von Spreckelsen et al.

(10) Patent No.: US 6,877,630 B2
(45) Date of Patent: Apr. 12, 2005

(54) RESEALABLE GAS IMPERMEABLE SEALING ASSEMBLY

(75) Inventors: Henning von Spreckelsen, Surrey (GB); Peter Michael McGeough, Navan (IE)

(73) Assignee: Spreckelsen McGeough Limited, Surrey (GB)

( * ) Notice: Subject to any disclaimer, the term of this patent is extended or adjusted under 35 U.S.C. 154(b) by 3 days.

(21) Appl. No.: 10/414,558

(22) Filed: Apr. 9, 2003

(65) Prior Publication Data

US 2004/0200837 A1 Oct. 14, 2004

(51) Int. Cl.[7] ..... B65D 51/20
(52) U.S. Cl. ..... 220/258.1; 215/232
(58) Field of Search ..... 220/258.1, 258.3, 220/258.4, 304, 277, 255.1, FOR 206; 215/232, 354, 320, 45, 53, 249, 250, 341

(56) References Cited

U.S. PATENT DOCUMENTS 4,280,634 A 7/1981 Wiesenberger et al.
4,722,449 A * 2/1988 Dubach ..... 215/235
4,754,889 A * 7/1988 Debetencourt ..... 215/232
4,795,043 A * 1/1989 Odet et al. ..... 215/235
4,869,399 A 9/1989 Dubach

FOREIGN PATENT DOCUMENTS

FR 2766464 A 7/1997
GB 2171680 A 9/1986
GB 2350105 A 11/2000

* cited by examiner

*Primary Examiner*—Lien NGO
(74) *Attorney, Agent, or Firm*—Holland & Hart LLP; Francis A. Sirr

(57) ABSTRACT

Larger gas tight containers for products such as carbonated or pressurised drinks require a resealable sealing assembly. The gas leakage through the assembly in its ex-factory sealing condition determines the shelf life of the product. A sealing assembly provides a foil (8) across a neck (10) of the bottle. The foil is supported in the ex-factory sealing condition by a plate (40) of a plug (36) which depends from an over cap (4). The over cap is screwed to an outer wall of a tubular spout (6) that surrounds the neck (10) of the bottle. In the resealed condition the plug can be screwed deeper into the neck so that a secondary seal is formed between the plate and the neck.

7 Claims, 2 Drawing Sheets

RESEALABLE GAS IMPERMEABLE SEALING ASSEMBLY

CROSS REFERENCE TO RELATED APPLICATIONS

This non-provisional patent application claims the benefit of international PCT application number PCT/GB00/04211, entitled "RESEALABLE GAS IMPERMEABLE SEALING ASSEMBLY", filed by Spreckelsen McGeough Ltd. on international filing date 2 Nov. 2000, which application is incorporated by reference into this application in its entirety.

BACKGROUND OF THE INVENTION

The present invention relates to a gas impermeable sealing assembly for a container of pressurised fluid. The invention is particularly applicable to gas impermeable containers such as PET or glass bottles.

1. Technical Problem

In order to achieve a significant shelf life, a container of pressurised fluid must be sealed in such a manner that gas cannot escape. For larger containers of, for example, carbonated drinks, the consumer may not wish to use all of the contents at once. There is therefore a demand for a resealable closure.

2. Prior Art Solutions

A metal crown cork is a conventional gas impermeable sealing assembly. However it is not resealable and is not suitable for a PET bottle.

Typically PET or glass bottles will have an injection-moulded polyethylene cap that screws on to a preformed open neck which is part of the PET or glass bottle. A wad of low density polyethylene sealing material that engages against the open neck is provided in the top of the cap. Alternatively, the cap may have a depending valve, which seats inside the neck.

When PET containers are filled at a pressure of 3 to 5 bar, the $CO_2$ permeability of the container cap assembly of the prior art is not as good as that provided by a glass bottle with a metal cap. The shelf life is also determined by the penetration of oxygen into the container and by migration of aldehydes from the PET container into the product. Glass provides a perfect oxygen barrier. PET, depending upon the treatment, has an oxygen permeability which varies between 0.0049 $cm^3$ per day to 0.0012 $cm^3$ per day. Technical advances continue to be made which reduce the level of oxygen and carbon dioxide permeability of PET containers to levels comparable to that of glass and tin cans. The closure of the container is therefore now of fundamental importance in maintaining the overall performance of the container as an oxygen and carbon dioxide barrier.

It has been proposed to place an oxygen scavenger in the lining of the cap.

Ascorbates such as $NaSO_2$ which oxidises to $NaSO_3$ have been employed for this purpose. These ascorbates are relatively expensive and increase the overall cost of the container, which can be commercially critical.

Aluminium seals have been proposed but once removed there is no method of resealing such a closure and maintaining pressure insider the container.

There is, therefore, a technical problem to provide a cap that acts as an oxygen and carbon dioxide barrier such that the overall container in its ex-factory sealed condition loses less than 10% of carbon dioxide over a six-month shelf life. At present a standard untreated PET bottle loses 36% of the carbon dioxide after six months. This can be reduced by the use of so-called "multi-layered" PET bottles or bottles which have been treated with an amorphous carbon treatment on their internal surface, such as that offered by the French company, Sidel (RTM) under the ACTIS trade mark.

SOLUTION OF THE INVENTION

In accordance with the present invention, there is provided a container having an open neck and a resealable sealing assembly providing an ex-factory sealing condition and a resealed condition for the container; the assembly comprising a foil providing a primary seal in the ex-factory sealing condition over the neck; a tubular spout surrounding and fitted to the neck; an over cap having means for removable engagement with an outer wall of the spout; a plug connected to the over cap and having a plate sealed to and supporting the foil in the ex-factory sealing condition and adapted to engage within the neck in the resealed condition.

ADVANTAGES OF THE INVENTION

Although a foil is gas impermeable, a thin foil would be ruptured by the gas pressure if not supported. The present assembly provides the necessary support to allow the use of a thin and therefore relatively light and inexpensive foil.

The presence of the tubular spout allows the assembly of the spout, over cap and foil to to be prepared separately and fitted to the neck of the container after filling. This makes for efficient operation in the filling plant and allows for a wider filing hole on the bottle (allowing faster filling) and a pouring neck and cap assembly with a diameter of choice.

BRIEF DESCRIPTION OF THE DRAWINGS

In order that the invention may be well understood an embodiment thereof will now be be described, by way of example only, with reference to the accompanying diagrammatic drawings, in which.

DETAILED DESCRIPTION OF A PREFERRED EMBODIMENT

Figure 1:
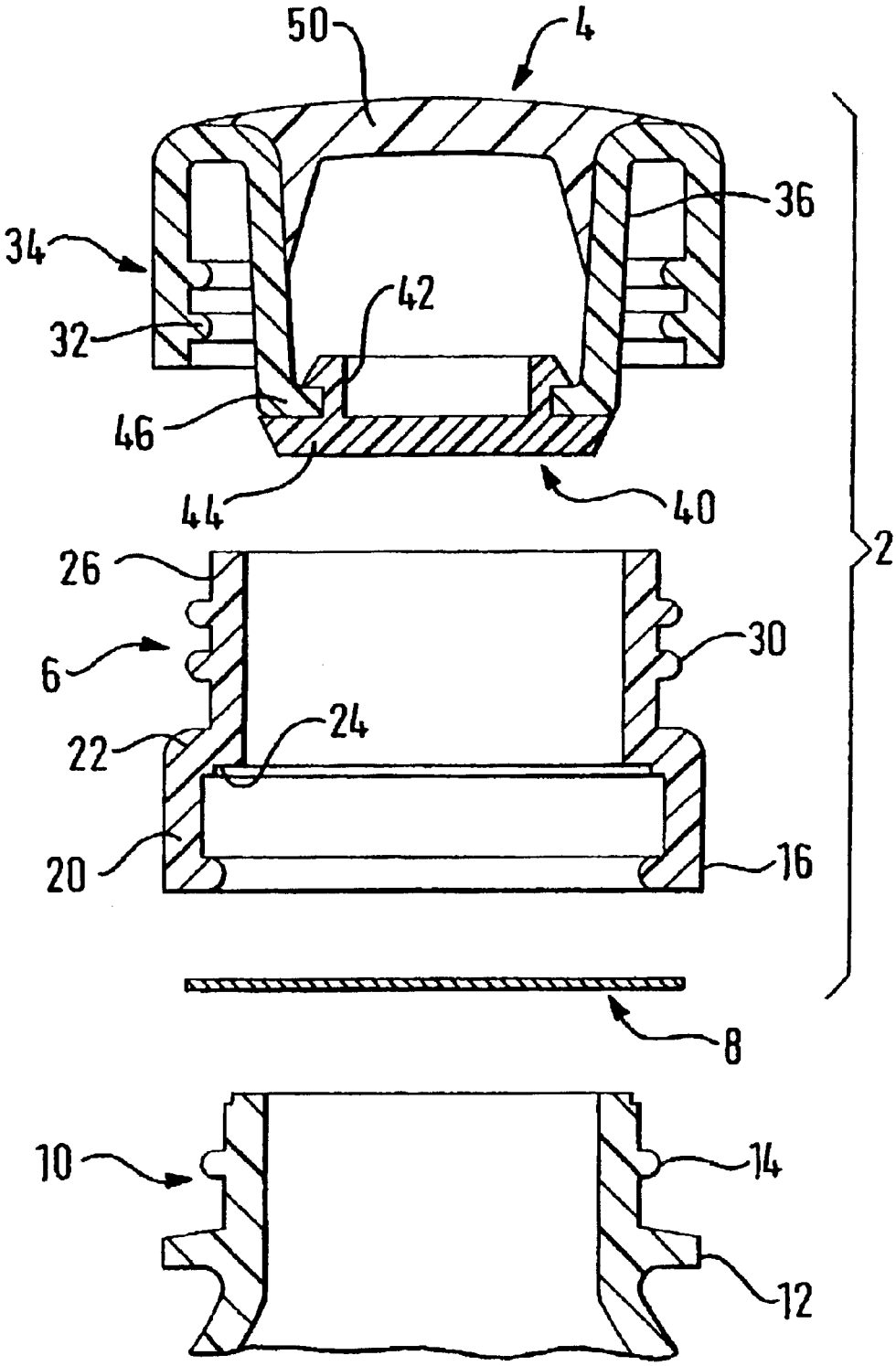
FIG. 1 shows an exploded view of the over cap, spout and foil of the resealable sealing assembly above a bottle neck.

The resealable sealing assembly 2 comprises an over cap 4, a tubular spout 6 and a foil 8. In the present embodiment, the resealable sealing assembly 2 is described as a cap closure for a bottle neck 10. The bottle may be a PET or PVC bottle formed from an injection-moulded preform that is blow moulded to the required shape, or a glass jar or bottle.

The neck 10 of the bottle is open and is provided with a projecting flange 12 to limit downward movement of the resealable sealing assembly during fitting and a rib 14 which projects from an outer wall of the neck to interlock with an inwardly projecting rib 16 of the spout 6.

The foil 8 may be a polymer foil or a polymer foil laminated to an aluminium foil or aluminium. The foil is selected so that it is capable of being bonded on both sides and torn with minimal user force. Any layer of polymer must also be sufficiently thin so as not to inhibit the tearability of the foil. A foil of aluminium of thickness between 12 and 25 microns with polymer layers on both sides of between 15 and 30 microns will tear easily in use while maintaining the necessary gas tight seal when supported by the over cap. Thinner polymer layers are also possible. The foil 8 is preferably supplied already bonded within the resealable sealing assembly.

The spout 6 is preferably an injection moulded polyethylene or PET component. It surrounds and is fitted to the neck 10 of the bottle. The spout comprises a skirt 20 that surrounds the neck and terminates in an inwardly projecting rib 16. A shoulder 22 is formed in the spout where it seats on top of the open mouth of the neck 10 and sandwiches the foil 8 between a surface 24 of the spout and an upper face of the open mouth of the neck. Both these co-operating surfaces may be stepped as shown in FIG. 1 to facilitate correct engagement during the assembly process.

The spout 6 has a tubular outer wall 26 extending upwardly from the shoulder 22. In an outer surface of the wall 26 a screw thread or a plurality of projecting ribs 30 are formed to co-operate with corresponding formations 32 on an inner surface of an outer wall 34 of the over cap 4.

The over cap 4 has a plug 36 which depends from a top of the cap within the outer wall 34. A base of the plug 36 is formed by a circular plate 40. In this embodiment the plate 40 is a separate component which is mounted to a wall of the plug by means of an annular latching ring 42 which defines an outwardly facing recess 44 into which an annular inwardly projecting edge 46 of the wall of the plug fits. This assembly allows the plate 40 to swivel relative to the rest of the over cap.

In an alternative embodiment (not shown) the plate 40 is integrally moulded with the depending wall of the plug.

An open top of the plug 36 is closed by means of a cavity plug 50 which push fits within the top to give a neat finish.

Method of Use

Figure 2:
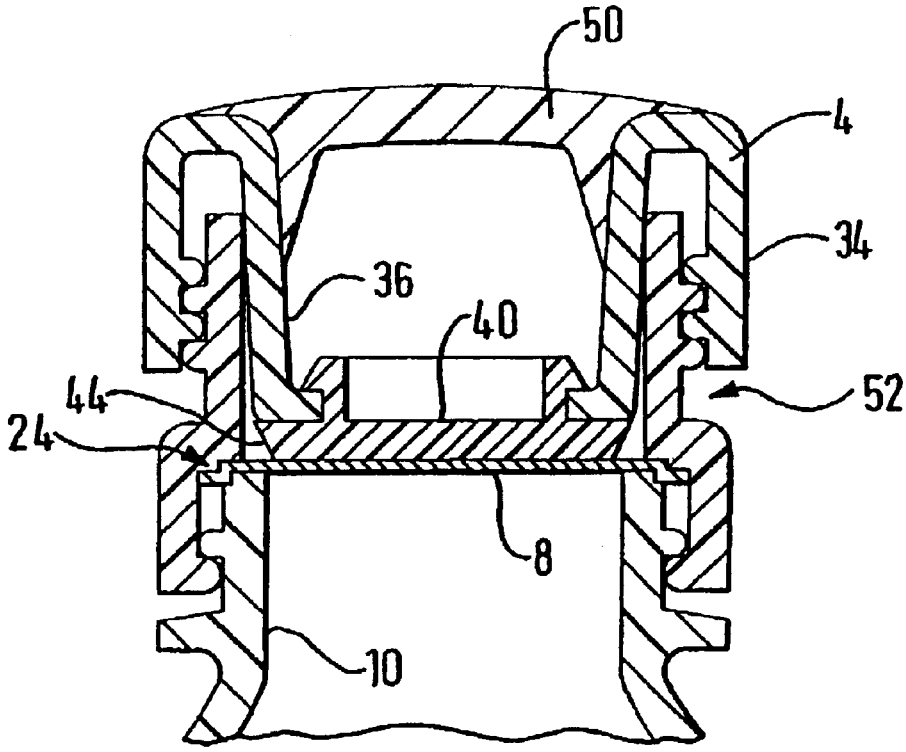
FIG. 2 shows the resealable sealing assembly in its ex-factory sealing condition.

The ex-factory sealing condition of the resealable sealing assembly is shown in FIG. 2. The over cap 4 is screwed onto the spout so that the plate 40 supports the sealing foil 8 which lies in the open plane of the mouth of the neck 10. The foil 8 is welded to the base of the plate 40, and the surface 24 of the spout and the upper surface of the neck. The over cap 4, spout 6 and foil 8 are provided pre-assembled so that only the step of fitting the skirt 20 of the spout to the neck and heat sealing the assembly together is left to be completed. The sealing of the foil 8 over the open mouth of neck 10 provides the primary seal in this ex-factory sealing condition.

In this ex-factory sealing condition there is an exposed annular gap 52 between the base of the wall 34 and the shoulder 22. The presence of this gap 52 serves as evidence that the resealable sealing assembly has not been tampered with while the product was on the shelf. Alternatively (not shown) a tamper evident tear band at the base of the wall 34 of the cap can be used to cover the gap 52.

When the assembly is to be opened the user rotates the over cap 4 relative to the spout 6. This causes a shearing force on the foil 8 which tears the foil in the annular region surrounding the plug 36. The swivel mounting of the plate 40 relative to the over cap allows the over cap to start rotating before the foil starts to tear. This allows the cap to be opened with a smaller starting torque. Once the cap is loosened the upward movement of the plug will reduce the support for the foil 8 and the pressure within the container will assist in rupturing the foil 8.

Figure 3:
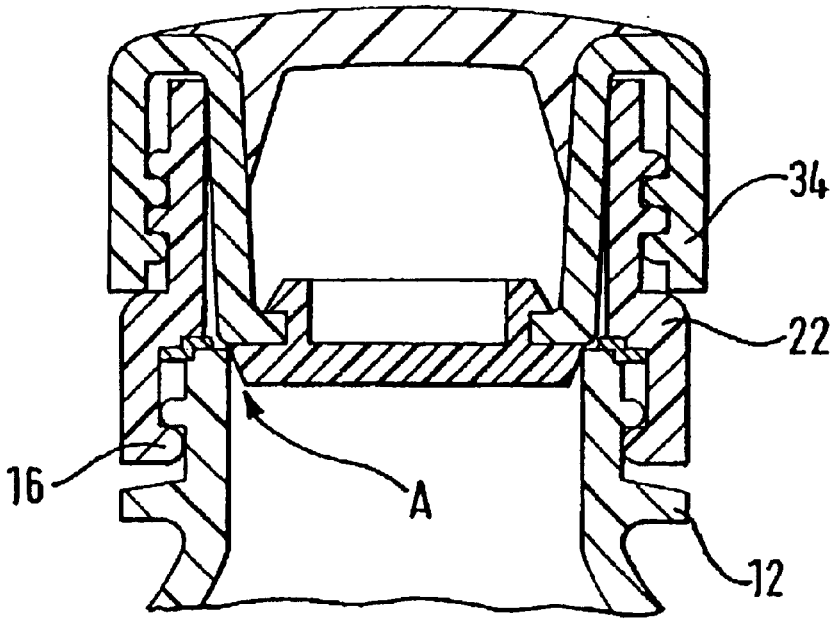
FIG. 3 shows the resealable sealing assembly in its resealed condition.

FIG. 3 shows the resealed condition of the resealable sealing assembly. In this condition the foil 8 is no longer intact. When the over cap 4 is screwed fully down onto the spout 6 the edge of the wall 34 rests on the shoulder 22. This limits further downward movement of the cap. In this position, the plate 40 has entered the mouth of the neck 10 and a secondary seal is formed by the engagement of the edge of the plate 40 with an inner edge of the mouth of the neck as shown at the region marked A. Preferably, the plate 40 has a bevelled edge in order to permit easy entry into the mouth of the neck and to ensure that a secondary seal is formed even if the dimensions of the necks of the bottles vary.

It will be appreciated that the shelf life of the product stored in a container sealed with such a resealable sealing assembly is considerably extended because the primary seal provided by the foil has a high level of gas impermeability.

The use of separate spout 6 results in a saving in the amount of neck material used in the the preform of the bottle.

What is claimed is:

1. In combination, a container having an open neck and a resealable sealing assembly that provides both an ex-factory sealing condition and a resealed condition for the container, the sealing assembly comprising:

a foil engaging the neck and providing a primary seal in the ex-factory sealing condition;

a tubular spout surrounding and fitted to the neck;

an over cap having means for removable engagement with an outer wall of the spout;

a plug connected to the over cap, the plug having a base plate that is directly and weldingly sealed to and supporting the foil in the ex-factory sealing condition, the base plate including a beveled edge that is adapted to sealingly engage within the neck in the resealed condition;

such that initial removal of the over cap and plug from the spout operates to rupture the foil; and such that subsequent replacement of the over cap and plug on the spout operates to cause the beveled edge of the base plate to engage and seal the neck.

2. The combination of claim 1 wherein the plate is mounted to the plug so that the plate can rotate relative to the plug.

3. The combination of claim 1 wherein the plate is integrally formed with the plug.

4. A primary/secondary sealing-assembly for fitting to the open neck of a container, comprising:

a hollow spout having a bottom portion for mounting on the open neck of a container;

a foil sealed to said spout, said foil having a top surface and a bottom surface providing a primary-seal for the open neck of the container when said spout is mounted on the open neck of the container;

an over-cap removable engaging a top portion of said spout; and a plate connected to said over-cap and directly and weldingly sealed to said upper surface of said foil, such that rotation of said over-cap in one direction relative to said spout operates to raise said over-cap and said plate and to shear-rupture said foil as said over-cap is removed from said spout, and such that subsequent replacement of said over-cap on said spout followed by rotation of said over-cap in a direction opposite to said one direction relative to said spout operates to lower said over-cap and said plate into a secondary-seal with the open neck of the container.

5. The resealable sealing-assembly of claim 4 including:

a beveled edge on said plate for providing said secondary-seal engagement with the open neck of the container.

6. A method of providing both a primary-seal and a secondary-seal to a container having an open neck, comprising the steps of:

providing a hollow spout having an open top portion, an open intermediate portion, and an open bottom portion;

providing a thin foil having a top surface and a bottom surface;

sealed said top surface of said foil to said intermediate portion of said spout;

providing a plate having a bottom surface;

rotatably mounting said plate within said top portion of said spout;

securing said bottom surface of said plate to said top surface of said foil; and mounting said bottom portion of said spout on the open neck of a container, such that said bottom surface of said foil provides a primary-seal for the open neck of the container, such that subsequent rotation of said plate in one direction relative to said spout operates to raise said plate and to shear-rupture said foil as said plate is removed from said spout, and such that replacement of said plate on said spout, followed by rotation of said spout in a direction opposite to said one direction, operates to lower said plate into a secondary-seal with the open neck of the container.

7. The method of claim 6 including the step of:

providing a secondary-seal beveled edge on said plate for engagement with the open neck of the container.

* * * * *

UNITED STATES PATENT AND TRADEMARK OFFICE

CERTIFICATE OF CORRECTION

PATENT NO. : 6,877,630 B2
DATED : April 12, 2005
INVENTOR(S) : von Spreckelsen et al.

It is certified that error appears in the above-identified patent and that said Letters Patent is hereby corrected as shown below:

Column 1,
Line 8, delete "on international", and insert -- of, and is a U.S. National Phase application of, international --.

Signed and Sealed this

Eighteenth Day of October, 2005

JON W. DUDAS
*Director of the United States Patent and Trademark Office*

UNITED STATES PATENT AND TRADEMARK OFFICE

CERTIFICATE OF CORRECTION

PATENT NO. : 6,877,630 B2
APPLICATION NO. : 10/414558
DATED : April 12,2005
INVENTOR(S) : Henning von Spreckelsen et al.

It is certified that error appears in the above-identified patent and that said Letters Patent is hereby corrected as shown below:

This certificate supersedes certificate of correction issued October 18, 2005. The certificate was issued in error and should be deleted. The correction is inconsistent with the prior decision from the PTO dated August 9, 2005 denying the change to Column 1 line 8.

Signed and Sealed this

Fifteenth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,877,630 B2
APPLICATION NO. : 10/414558
DATED : April 12, 2005
INVENTOR(S) : von Spreckelsen et al.

It is certified that error appears in the above-identified patent and that said Letters Patent is hereby corrected as shown below:

Cover sheet, before "(51)", insert --Related U.S. Application Data
(63) Continuation of International Application PCT/GB00/04211, filed on November 2, 2000, now abandoned--;
Column 1, line 7, delete "claims the benefit" and insert --is a continuation--; and
Column 1, line 11, following "2000, ", insert --now abandoned, --.

Signed and Sealed this

Sixth Day of February, 2007

JON W. DUDAS
*Director of the United States Patent and Trademark Office*